US005947388A

United States Patent [19]

Woodruff

[11] Patent Number: 5,947,388

[45] Date of Patent: Sep. 7, 1999

[54] ARTICULATED POLE FOR SPRAYING OF FLUIDS

[75] Inventor: Byron J. Woodruff, Santa Clara, Calif.

[73] Assignee: Paint Trix Inc., Sunnyvale, Calif.

[21] Appl. No.: 09/061,936

[22] Filed: Apr. 17, 1998

[51] Int. Cl.[6] ..... B05B 15/08

[52] U.S. Cl. ..... 239/532; 239/587.5

[58] Field of Search ..... 239/525, 532, 239/587.1, 587.5, 588

[56] References Cited

U.S. PATENT DOCUMENTS 5,292,074 3/1994 Clark et al. ..... 239/588 X
5,372,389 12/1994 Tam et al. ..... 285/94
5,546,749 8/1996 Couchee ..... 60/370

*Primary Examiner*—Lesley D. Morris
*Attorney, Agent, or Firm*—Thomas Schneck

[57] ABSTRACT

An articulated pole for use as an extension in fluid spraying devices. The pole includes a flexible high pressure fluid hose that passes through a hinge which is part of a tubular outer housing. The fluid hose transports the fluid under pressure from a fluid source, connected on one end of the pole, to a spray tip nozzle, located on the other end of the pole. The hinge can be locked at any angle through its full range of pivotal movement or can be adjusted to customize the level of friction required for continuous pivot movement. Multiple hinges can be placed along the pole to allow for compound bending moments and to allow greater maneuverability for the person operating the fluid spraying device.

19 Claims, 3 Drawing Sheets

ARTICULATED POLE FOR SPRAYING OF FLUIDS

TECHNICAL FIELD

The present invention relates to fluid application devices. Specifically, the present invention relates to extension poles particularly suited for fluid spraying equipment.

BACKGROUND ART

Many fluid spraying devices, such as airless paint spray guns, are often fitted with extensions or wands to increase the reach of the operator. These extensions vary in length and consist primarily of a rigid tube able to withstand hydraulic pressures in a range of 2,000–3,500 psi. Wands are generally of short length, about 6 inches to 24 inches, and consist of a small tube section with a fitting at one end which attaches to a spray gun and a threaded section at the other end to accept the spray tip. An extension is generally of a longer length and encloses a small diameter, high pressure tube, or fluid section, within a larger tube section.

Spray tips are designed to provide a spray fan of an exact shape and size in order to evenly coat a surface. The directional relationship of the spray tip to the work surface is critical to the process of achieving even coverage. When the spray tip is remotely positioned at the end of a wand or an extension, the ability of the operator to angle or maneuver the spray tip becomes severely restricted. To maintain the relationship of the spray fan to the work surface when using an extension device, some sort of swivel or pivot mechanism must be fitted between the extension pole and the spray tip.

Most swivel devices that are presently in use, are constructed as separate units that are then attached to the extension pole. They do not constitute any part of the pole structure and the swivel action is generally 180 degrees of pivot or less. They are generally constructed using two overlapping assemblies with a bolt through the pivot access. One of the overlapping assemblies is threaded onto the pole, and the other is fitted with a threaded portion which accepts the spray tip. Both assemblies have hollow passages for the material flow. The key component is the bolt which forms the pivot access. The bolt is either of a hollow design or is solid and sealed at either end and then tightened to create a sealed area machined about it. These techniques allow fluid to flow from one pivoting component to the other without leaking.

The swivel devices described above are required to operate under high pressure, 2,000–3,500 psi, over thousands of pivot cycles without leaking, while still providing a low friction, easy to pivot, joint. To provide for both an effective pressure seal and bearing, washers or "O" rings of special design are fitted around the joint. Because these washers or "O" rings are required to fulfill the dual role as both a bearing and a seal, the washers have a built-in level of friction and offer no provision for being locked in place. Thus, the bearing washers are prone to wear in the abrasive environment in which they operate. As the wear increases on the bearing washers, leaks become a common problem.

For obvious reasons, leaks are a liability. High pressure fluid leaks can be a physical danger to both the operator and to those in close proximity. The current swivel devices must be built in a substantial manner and to exact specifications in order to withstand the pressures involved. Rigorous assembly standards must be maintained. Generally, they are a complicated and exacting component to manufacture and, regardless of the manufacturing care taken, they represent a certain level of liability risk. Additionally, the present swivel devices are constructed in such a way as to require the operator to physically grab hold of the spray tip itself to induce the force required for the swivel to pivot. Although the spray tips are fitted with guards of varying levels of protection, there is a risk of high pressure fluid injection to the hands or the fingers.

U.S. Pat. No. 5,546,749 shows an articulated nail gun handle extension. The abstract of the patent indicates that the tool is suitable for any air powered hand tool. The air supply line is tapped into the extension element and the device includes a jointed, tubular extension that affixed to the tool. It also includes a trigger mechanism that controls the operation of the tool, and a grip to allow the user to easily support the weight of the tool. U.S. Pat. No. 5,372,389, to Tam et al., reveals a prior art fitting which carries pressurized material, such as paint. The fitting is jointed and is the type of device in which the present invention is intended to replace.

It is the object of the present invention to provide an improved extension pole for use in airless fluid spraying, the extension pole being lighter, easier to manufacture and maintain, non-leaking, and having a swivel hinge assembly that can be easily adjusted and adaptable for use by the operator.

SUMMARY OF THE INVENTION

The above object has been met by an articulated extension pole featuring a flexible high pressure fluid hose that passes through a hinge that is built into a tubular outer housing. The hinge is fixed to the outer housing and is not in contact with the fluid hose. The fluid hose transports a fluid, such as paint, from a fluid source which is attached to one end of the pole to the spray tip nozzle on the other end of the pole. The hinge can be locked at any angle through its full range of pivotal movement or can be adjusted to customize the level of friction required for continuous pivot movement. Multiple hinges can be placed anywhere along the pole to allow for compound bending moments. This greatly increases the versatility and reach capability and allows the operator to reach awkward areas while applying the fluid.

Since no fluid passes through the hinge, all fluid passes through the flexible fluid hose, there is no need to be concerned about pressure seals and bearings wearing out and causing high pressure fluid leaks. Additionally, because the pressurized fluid is contained only in the fluid hose and not in the entire tubular housing, the extension pole is much lighter and easier to operate. The adjustability of the hinges and the ability to place multiple hinges in the extension pole allow for operators to easily adapt the pole and maneuver the spray tip nozzle to access places that are difficult to reach.

BEST MODE OF CARRYING OUT THE INVENTION

Figure 1:
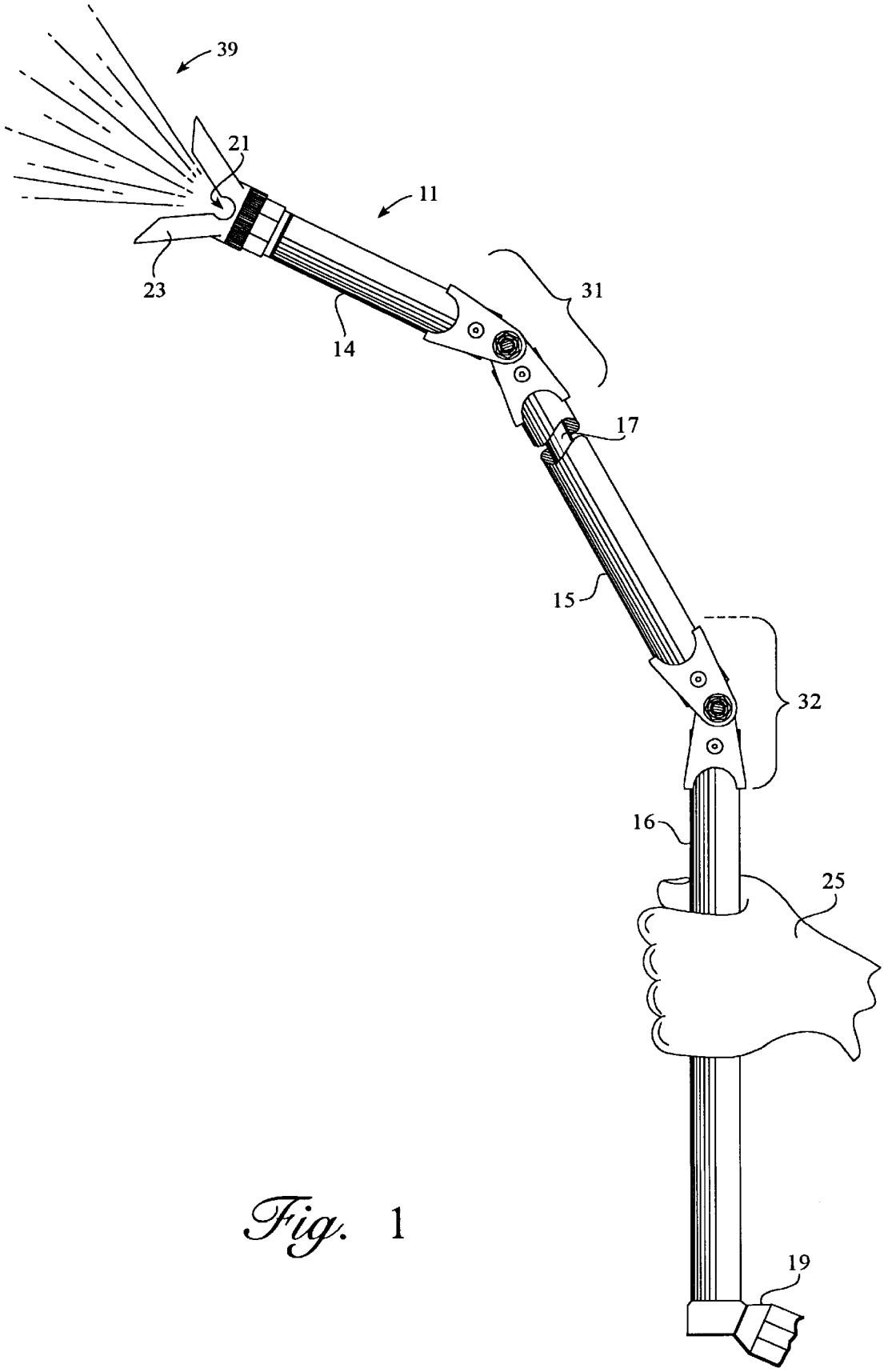
FIG. 1 is a side view of a first embodiment of the present invention.

Referring to FIG. 1, an articulated pole 11 for spray painting is shown. In the first embodiment of the present invention, there are two hinges, hinge 31, and hinge 32. The hinges are connected between three pieces of tubular outer housing, 14, 15, 16. Hinge 31 is connected between outer housing 14 and outer housing 15, while hinge 32 is connected between outer housing 15 and outer housing 16. The outer housing is generally of a tubular shape, which provides the overall shape and structure of the spray pole. In the preferred embodiments of the invention, the pieces of housing, 14, 15, 16, are made of aluminum having a thickness of 0.090 inches to 0.125 inches. The length of the pieces of outer housing may vary depending on how the extension is being used. The overall length of the pole 11 would typically be about 2 or 3 feet long.

The pole 11 extends from an inlet attachment 19 on one end to a spray nozzle 21 on the other end. The inlet attachment 19 connects to a fluid source, such as a high pressure paint spray gun. A flexible high pressure hose 17 is enclosed within the outer housing 14, 15, 16 and is connected at the inlet attachment 19 such that the fluid from the fluid source flows through the flexible high pressure fluid hose 17. The fluid hose 17 is generally a standard high pressure hose rated to withstand a pressure of 3,500–11,000 psi, and having an outer diameter of 3/16 inch. The hose 17 extends the length of the pole 11 and terminates at the nozzle 21. At the nozzle, the fluid 39 sprays out of the nozzle 21 for application on a surface. A nozzle guard 23 is attached to the end of the nozzle 21 in order to provide protection against accidental fluid injection.

The hinges 31 and 32 allow the operator to pivot the pole 11 to achieve the desired angles that are needed to adequately apply fluid to the surface. The length of the housing 16, between the lower hinge 32 and the inlet attachment 19, should be long enough to allow the operator's hand 25 to comfortably grip the pole 11 without coming into contact with the inlet attachment 19. Also, the length of housing 14, near the nozzle 21, can be made of a length so as to provide a lever for the operator to bump or tap the housing 14 against a wall or surface for adjusting the angle of the nozzle 21. This eliminates the need for the operator to have to lower the extension pole 11 and pivot the hinge 31 by hand, which reduces the risk of the operator coming into contact with the high pressure fluid 39 exiting the nozzle 21.

Figures 2, 3:
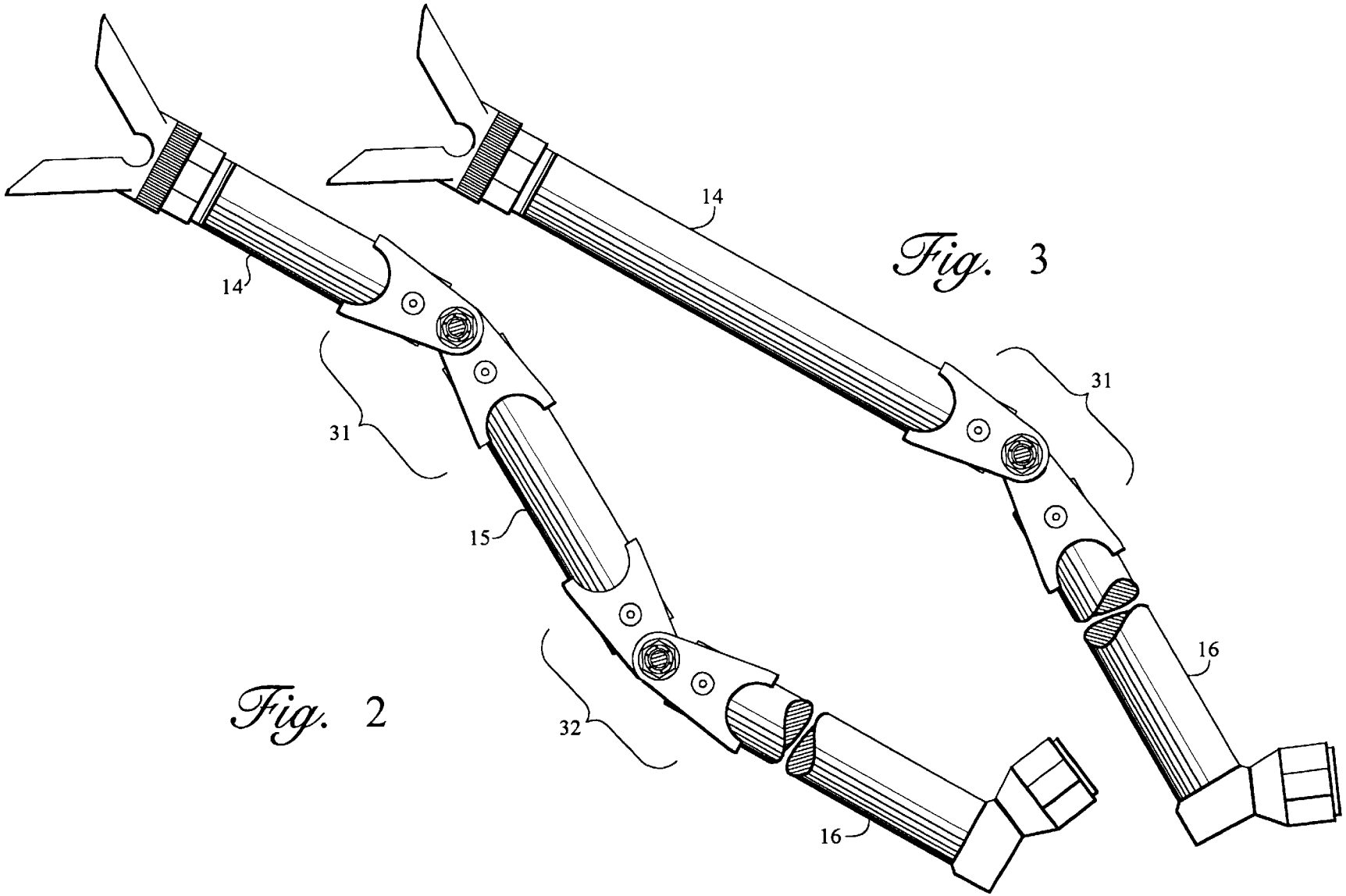
FIG. 2 is a side view of a first embodiment of the present invention.
FIG. 3 is a side view of a second embodiment of the present invention.

In the first embodiment shown in FIG. 2, there are two hinges 31 and 32 which interconnect three sections of housing 14, 15, and 16. Alternatively, FIG. 3 shows a second embodiment of the invention where there is one hinge 31 which connects two pieces of housing 14 and 16. The present invention may also have other embodiments having multiple hinges and pieces of housing, depending on how much bending is desired.

Figure 4:
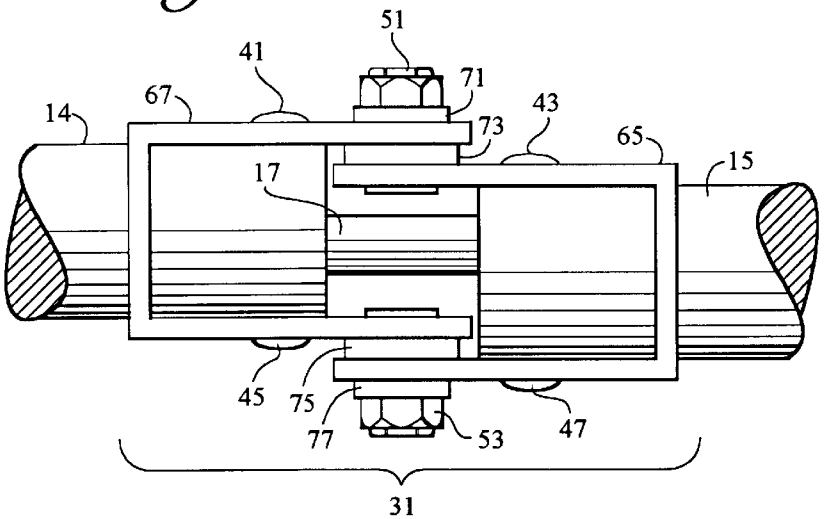
FIG. 4 is a top view of a second embodiment of the present invention, including a top view of a hinge used in the present invention.

In FIG. 4, the hinge 31 includes two metal, jointed, U-shaped members 67 and 65. One member 67 is attached to one piece of housing 14 by rivets 41 and 45. The other member 65 is attached to the other piece of housing 15 by rivets 43 and 47. The two members 67 and 65 are secured together by lock nuts 51 and 53. The lock nuts are preferably the type that are known as "elastic stop" nuts. "Elastic stop" is a registered trademark owned by Harvard Industries Inc. The "elastic stop" nut functions as a anti-vibration locking device. Lock nut 51 is separated from members 67 and 65 by washers 71 and 73. Lock nut 53 is separated from members 67 and 65 by washers 75 and 77. The washers are generally made of either nylon or Teflon and prevent the metal members from grinding on one another when the hinge is being pivoted. The lock nuts 51 and 53 may be tightened to the desired degree of swivel required. However, if it is desired that the hinge be locked at a permanent angle, the washers 71, 73, 75, and 77 may be removed from the hinge assembly 31. Additional locking features, such as pins and clips, could be added. The locking feature prevents accidental movements due to the pole hitting other objects or due to a bending force being applied while using the pole with some other accessories.

Figure 5:
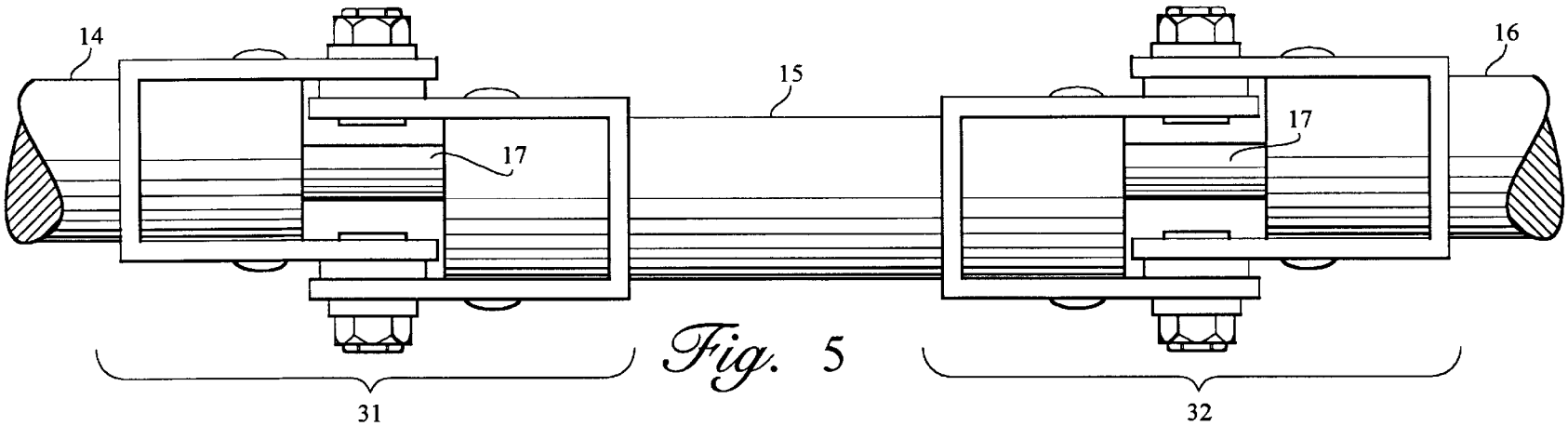
FIG. 5 is a top view of the hinges used in a first embodiment of the present invention.

In FIG. 5, the embodiment includes three pieces of housing 14, 15, and 16 connected by two hinges 31 and 32.

Figure 6:
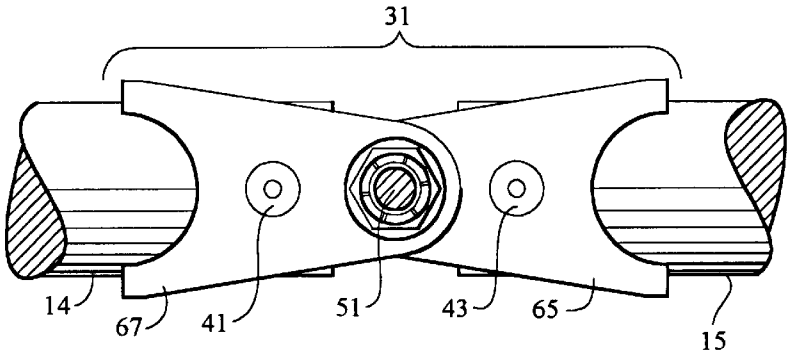
FIG. 6 is a side view of a hinge used in the present invention.

As can be seen in FIGS. 4 and 5, the flexible high pressure fluid hose 17 is not affected by the hinge 31. When the hinge 31 pivots, the flexible hose 17 flexes, but there is no need to use pressure seals and bearings to prevent leaks in the housing because the hinge and housing are not subject to the high pressure. FIG. 6 shows a side view of the hinge 31. As shown, the two pieces of housing 14 and 15 are secured to members 67 and 65 by rivets 41 and 43 respectively. The lock nut 51 secures members 67 and 65 together.

Referring back to FIG. 1, since the pressurized fluid is confined into the smaller fluid hose 17, rather than in the outer housing, the pole 11 is much lighter than the poles used in the prior art. This greatly reduces the fatigue of the operator of the device. An additional advantage of the present invention is that there are no internal passages to clog or bind due to material residue. This makes the device much easier to maintain and to keep clean. Additionally, if one needed extra durability for a particular application, pivot bearing materials and sizes could be chosen solely for this purpose, since the bearings themselves do not serve as pressure seals. Also the level of pivot friction can be adjusted to suit the operator without the need to be concerned about leaks.

I claim:

1. An articulated pole for spraying of fluids comprising:

an inlet attachment for attaching the pole to a fluid source;

a nozzle, in fluid communication with the inlet attachment, defining a flow path over which a fluid travels;

a flexible fluid hose extending between the nozzle and the inlet attachment, the fluid hose serving to transport fluid from the inlet attachment to the nozzle;

an elongated tubular housing, segmented into a plurality of pieces, connected on one end to the nozzle and connected on a second end to the inlet attachment, the housing surrounding the fluid hose, the pieces joined by hinges.

2. An articulated pole for fluid spraying, as in claim 1, wherein the housing is segmented into a first piece and a second piece, with a hinge connected therebetween allowing the first piece of housing to pivot relative to the second piece of housing.

3. An articulated pole for fluid spraying, as in claim 1, wherein the housing is segmented into a first piece, a second piece and a third piece, a first hinge being connected between the first piece and the second piece to allow the first piece to pivot relative to the second piece, and a second hinge being connected between the second piece and the third piece to allow the second piece to pivot relative to the third piece.

4. An articulated pole for fluid spraying, as in claim 1, wherein each hinge includes a pair of brackets, each bracket being secured to one of the pieces of housing and having an end secured to the end of the other bracket such that the hinge pivots at a point where the ends of the brackets are joined.

5. An articulated pole for fluid spraying, as in claim 1, wherein each hinge is locked at a desired angle so as to affix the pieces of housing in a stationary position.

6. An articulated pole for fluid spraying, as in claim 1, wherein the hinge has a pivoting limit, the pivoting limit being adjustable.

7. An articulated pole for fluid spraying, as in claim 1, wherein the flexible fluid hose is of a high pressure type, the hose being rated to withstand a pressure greater than 2000 psi.

8. An articulated pole for fluid spraying comprising:

an inlet attachment for attaching the pole to a fluid source;

a nozzle, in fluid communication with the inlet attachment, defining a flow path over which a fluid travels;

a flexible fluid hose extending between the nozzle and the inlet attachment, the fluid hose serving to transport the fluid under pressure from the inlet attachment to the nozzle;

an elongated tubular housing, segmented into a first piece of housing and a second piece of housing, each piece of housing having a first end and a second end, the first end of the first piece of housing being connected to the inlet attachment, the first end of the second piece of housing being connected to the nozzle, the tubular housing surrounding the flexible fluid hose; and a hinge having jointed U-shaped members disposed between the second end of the first piece of housing and the second end of the second piece of housing, each member being secured to one of the pieces of housing and having an end secured to the end of the other member such that the hinge pivots at a point where the ends of the members are joined allowing the second piece of housing to pivot relative to the first piece of housing.

9. An articulated pole for fluid spraying, as in claim 8, wherein the hinge is locked at a desired angle such that the second piece of housing remains stationary relative to the first piece of housing.

10. An articulated pole for fluid spraying, as in claim 8, wherein the hinge has a pivoting limit, the pivoting limit being adjustable.

11. An articulated pole for fluid spraying, as in claim 8, wherein the flexible fluid hose is of a high pressure type, the hose being rated to withstand a pressure greater than 2000 psi.

12. An articulated pole for fluid spraying, as in claim 8, further comprising:

a third piece of housing and a second hinge;

the third piece of housing being disposed between the hinge and the second hinge, the second hinge being disposed between the third piece of housing and the second end of the second piece of housing, the hinge allowing the first piece of housing to pivot relative to the third piece of housing and the second hinge allowing the second piece of housing to pivot relative to the third piece of housing.

13. An articulated pole for fluid spraying comprising:

an inlet attachment for attaching the pole to a paint source;

a nozzle, in fluid communication with the inlet attachment, defining a flow path over which a paint travels;

a flexible fluid hose extending between the nozzle and the inlet attachment, the fluid hose serving to transport the paint under pressure from the inlet attachment to the nozzle;

an elongated tubular housing wherein the housing is segmented into a first piece, a second piece, and a third piece, a first end of the first piece of housing being connected to the inlet attachment, a first end of the third piece of housing being connected to the nozzle, the housing surrounding the flexible fluid hose; and first and second hinges having jointed U-shaped members, the first hinge being disposed between the second end of the first piece of housing and the first end of the second piece of housing, the first hinge allowing the second piece of housing to pivot relative to the first piece of housing, the second hinge being disposed between the second end of the second piece of housing and the second end of the third piece of housing, the second hinge allowing the third piece of housing to pivot relative to the second piece of housing.

14. An articulated pole for fluid spraying, as in claim 13, wherein each member is secured to one of the pieces of housing and has an end secured to the end of the other member such that the hinge pivots at a point where the ends of the members are joined.

15. An articulated pole for fluid spraying, as in claim 13, wherein the hinges can be locked at a desired angle so as to affix the pieces of housing in a stationary position.

16. An articulated pole for fluid spraying, as in claim 13, wherein the hinges have a pivoting limit, the pivoting limit being adjustable.

17. An articulated pole for fluid spraying, as in claim 13, wherein the flexible fluid hose is of a high pressure type, the hose being rated to withstand a pressure greater than 2000 psi.

18. An articulated pole for fluid spraying comprising:

an inlet attachment for attaching the pole to a paint source;

a nozzle, in fluid communication with the inlet attachment defining a flow path over which a paint travels;

a flexible fluid hose extending between the nozzle and the inlet attachment, the fluid hose serving to transport the paint from the inlet attachment to the nozzle at a high pressure;

an elongated tubular housing, segmented into a number of pieces, the tubular housing being connected on one end to the nozzle and being connected on a second end to the inlet attachment, the housing encasing the fluid hose; and a number of hinges connected between the pieces of housing, each hinge including a pair of jointed, U-shaped members each member being secured to one of the pieces of housing and having an end secured to the end of the other member such that the hinge pivots at a point where the ends of the brackets are joined, each hinge having an adjustable pivoting limit.

19. An articulated pole for fluid spraying, as in claim 18, wherein each hinge can be locked at a desired angle so as to affix the pieces of housing in a stationary position.

* * * * *